US007736031B1

(12) United States Patent
Rashidi

(10) Patent No.: US 7,736,031 B1
(45) Date of Patent: Jun. 15, 2010

(54) LIGHTBULB HOUSING CONTAINING A FROSTED AND TRANSLUCENT LENS TO CONVERT THE VISUAL EFFECT OF A PLUG-IN FLUORESCENT LIGHTBULB INTO THE SAME VISUAL EFFECT AS AN INCANDESCENT BR30/BR40 REFLECTOR LIGHTBULB

(76) Inventor: Hamid Rashidi, 139 N. Clark Dr., Beverly Hills, CA (US) 90211

( * ) Notice: Subject to any disclaimer, the term of this patent is extended or adjusted under 35 U.S.C. 154(b) by 0 days.

(21) Appl. No.: 11/503,340

(22) Filed: Aug. 10, 2006

(51) Int. Cl.
*F21V 17/00* (2006.01)

(52) U.S. Cl. ..... 362/364; 362/382; 362/396; 362/362; 362/348; 362/346

(58) Field of Classification Search ..... 362/364, 362/382, 396
See application file for complete search history.

(56) References Cited

U.S. PATENT DOCUMENTS 5,073,845 A * 12/1991 Aubrey ..... 362/650
6,431,723 B1 * 8/2002 Schubert et al. ..... 362/147
6,447,145 B1 * 9/2002 Thomas et al. ..... 362/267
7,125,135 B2 * 10/2006 Ward ..... 362/147
2008/0007958 A1 * 1/2008 Chen ..... 362/364

* cited by examiner

*Primary Examiner*—Sandra L O'Shea
*Assistant Examiner*—Jessica L McMillan
(74) *Attorney, Agent, or Firm*—Thomas I. Rozsa

(57) ABSTRACT

The present invention is an improved lightbulb housing installed inside of a canister transversely affixed to a ceiling plate of a ceiling fixture, wherein the lightbulb used is a plug-in fluorescent lightbulb and the visual effect is modified to cause the visual effect to simulate a reflector lightbulb. The lightbulb housing comprises a hollow reflector, a frosted and translucent lens, and a top hollow cylindrical ring cover which receives a translucent lens. The hollow cylindrical ring cover is attached to the reflector and incorporates means by which it is attached to the interior of the canister. The frosted and translucent lens is sandwiched between a transverse interior shelf on the ring cover and the top of the reflector. A plug-in fluorescent lightbulb is installed into an electric plug within the canister of the ceiling fixture, however, because of the translucent and frosted lens, the plug-in fluorescent lightbulb is concealed and lighting effect simulates a reflector lightbulb.

16 Claims, 8 Drawing Sheets

LIGHTBULB HOUSING CONTAINING A FROSTED AND TRANSLUCENT LENS TO CONVERT THE VISUAL EFFECT OF A PLUG-IN FLUORESCENT LIGHTBULB INTO THE SAME VISUAL EFFECT AS AN INCANDESCENT BR30/BR40 REFLECTOR LIGHTBULB

BACKGROUND OF THE INVENTION

1. Field of the Invention

The present invention relates generally to a lightbulb housing affixed into a ceiling fixture which is used with plug-in fluorescent lightbulb.

2. Description of the Prior Art

A lightbulb housing is a well known apparatus for controlling the spread of light from a lightbulb to achieve a desired visual effect. In the prior art, a common type of lightbulb used is a screw in reflector lightbulb which has a wide bulb surface to provide whether flood lighting effect or a spot lighting effect. In general a reflector lightbulb can be seen from the lightbulb housing and provides an aesthetic visual effect Referring to FIG. 1, there is illustrated a prior art conventional lightbulb housing assembly 100*a* comprising a conventional reflector lightbulb 10*a*. The reflector lightbulb 10*a* is visible and provides a very aesthetic visual effect.

Due to changes in lighting requirements, the reflector lightbulb has frequently been replaced with a plug in fluorescent lightbulb. In the prior art, the plug in fluorescent lightbulb is also visible. However, the aesthetic effect of being able to see the plug in fluorescent lightbulb is far less attractive than the visual effect created by the reflector lightbulb. Therefore, there is a significant need to modify the visual effect of a plug-in fluorescent lightbulb so that it is far more attractive and provides a visual effect which is similar to the visual effect of a reflector lightbulb.

SUMMARY OF THE INVENTION

The present invention is an improved lightbulb housing installed inside of a canister transversely affixed to a ceiling plate of a ceiling fixture, wherein the lightbulb used is a plug-in fluorescent lightbulb and the visual effect is modified to cause the visual effect to simulate a reflector lightbulb. The lightbulb housing comprises a hollow reflector, a frosted and translucent lens, and a top hollow cylindrical ring cover which receives a translucent lens. The hollow cylindrical ring cover is attached to the reflector and incorporates means by which it is attached to the interior of the canister. The frosted and translucent lens is sandwiched between a transverse interior shelf on the ring cover and the top of the reflector. A plug-in fluorescent lightbulb is installed into an electric plug within the canister of the ceiling fixture, however, because of the translucent and frosted lens, the plug-in fluorescent lightbulb is concealed and lighting effect simulates a reflector lightbulb.

It has been discovered, according to the present invention, that if a ring assembly comprises means to retain a frosted and translucent lens and further comprises reflector means to which the ring assembly is attached, and also comprises means to attach the ring assembly to the interior of a ceiling fixture, then if a plug-in fluorescent lightbulb is installed into a plug within the ceiling fixture, the plug-in fluorescent lightbulb will be shielded by the frosted and translucent lens so that the plug-in lightbulb will not be visible as the illumination from the lightbulb is transmitted through the frosted and translucent lens ad the illumination effect will simulate the visual effect of the reflector lightbulb.

It has further been discovered, according to the present invention, that if the lightbulb is a plug in fluorescent lightbulb, the unsightly effects of the fluorescent lightbulb will be shielded by the present invention.

It has also been discovered, according to the present invention, that if a sealing gasket is positioned between the frosted and translucent lens and the transverse interior shelf of the ring assembly, then the frosted and translucent lens will be better sealed and seated within the ring assembly.

It has additionally been discovered, according to the present invention, that if the frosted and translucent lens is positioned so that it is above the means by which the attaching means of the assembly are affixed to the ring assembly, then the unsightly attaching means will be concealed and will not be visible through the translucent lens.

It has also been discovered, according to the present invention, that if the ring assembly has a transverse outer ring which can be used for decorative purposes and has a sealing ring adjacent its interior surface, then the sealing ring can be used to seal the canister of the ceiling fixture when the ring assembly is attached by a press fit against the canister so that the outer transverse ring serves an aesthetic and decorative purpose and the canister of the ceiling fixture can be sealed.

It has also been discovered, according to the present invention, that if the interior wall of the ring which retains the frosted and translucent lens has an interior surface above the lens and is therefore visible, then the visual effect of the illumination can be varied depending on whether the interior surface is smooth or has baffles thereon.

It is therefore a primary object of the present invention to provide a means by which a frosted and translucent lens can be attached to a'reflector and ceiling fixture so that the plug-in fluorescent lightbulb within the ceiling fixture and which extends through the reflector is concealed so that when illuminated, the illumination shines through the frosted and translucent lens but the plug-in fluorescent lightbulb is hidden from view and the illumination effects simulates the illumination from a reflector lightbulb.

It is a further object of the present invention to provide means by which the assembly housing the frosted and translucent lens can be press fit into the ceiling fixture and retained therein.

It is another object of the present invention to incorporate sealing means into the assembly which retains the frosted and translucent lens so that the ceiling fixture will be sealed when the assembly housing the frosted and translucent lens is affixed to the sealing fixture.

It is also an object of the present invention to provide means in the improved lightbulb assembly to permit the wiring from the electric plug receiving the lightbulb to extend through the reflector of the present invention assembly.

It is also another object of the present invention to incorporate a decorative ring into the assembly which retains the translucent lens.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an improvement to eliminate the unsightly appearance of a plug-in fluorescent lightbulb in a ceiling fixture by concealing the interior of the lightbulb housing with a frosted and translucent lens so that the interior of the housing is concealed and therefore the plug-in fluorescent lightbulb is concealed to thereby provide a far more beautiful aesthetic appearance when the light shines through the lens and simulates the illumination effect of a reflector lightbulb. In a preferred embodiment, the frosted and translucent lens assembly is affixed by snapper assemblies which are attached to the lens retaining apparatus and which are concealed by the frosted and translucent lens.

Figure 3:
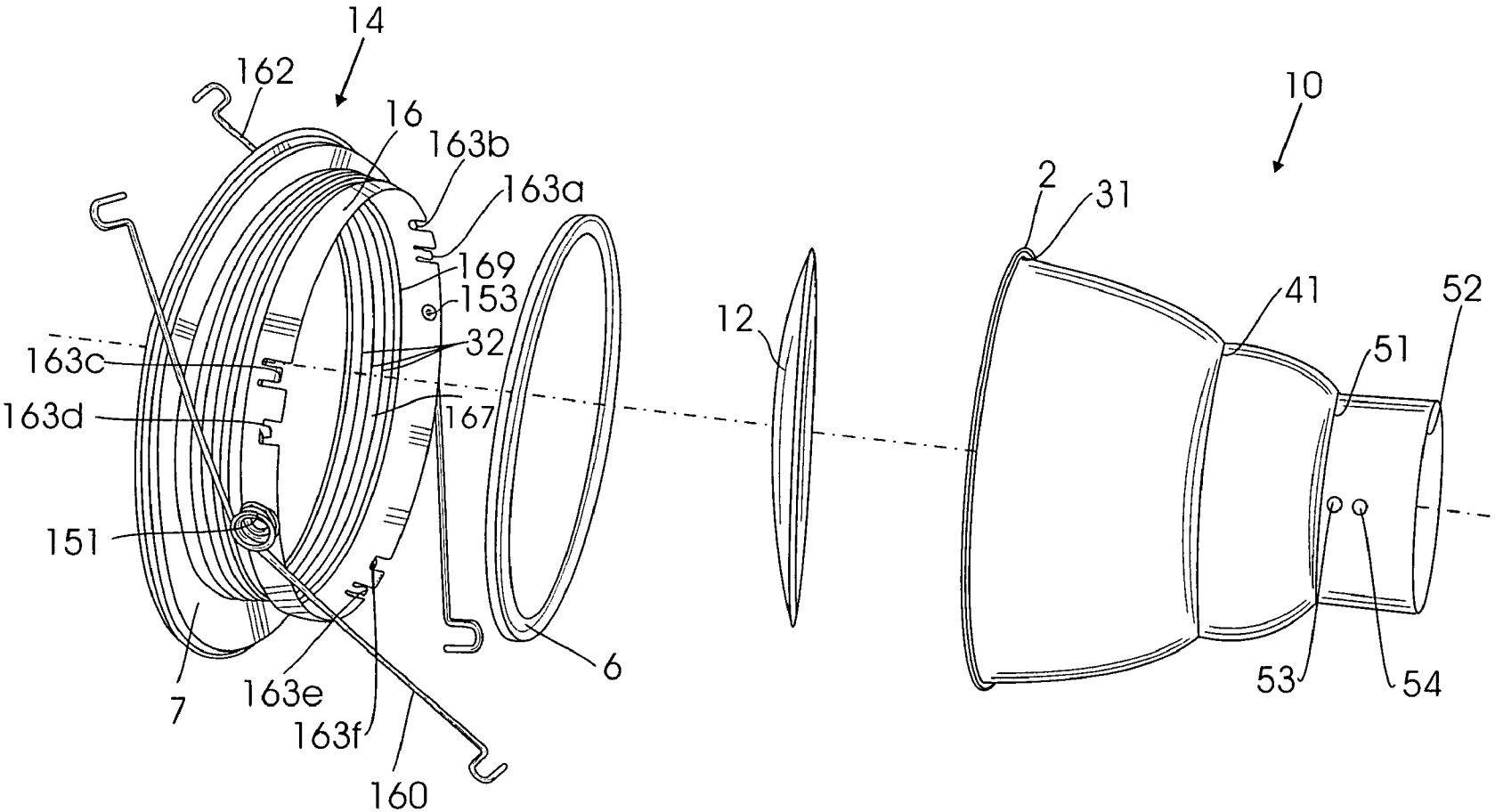
FIG. 3 is an exploded view of the present invention means for retaining the translucent and frosted lens on the reflector placed into a ceiling fixture.

Referring to FIG. 3, there is illustrated a perspective view of a lightbulb assembly containing the present invention improved lightbulb housing 100. The lightbulb assembly 200 comprises lightbulb retaining means such as a canister 91 transversely affixed into a ceiling plate 90 which has conventional means to be mounted into a ceiling. The present invention lightbulb housing 100 is retained within the canister 91 so that a source of illumination such as lightbulb within the present invention improved lightbulb housing 100 can shine downwardly.

Figure 2:
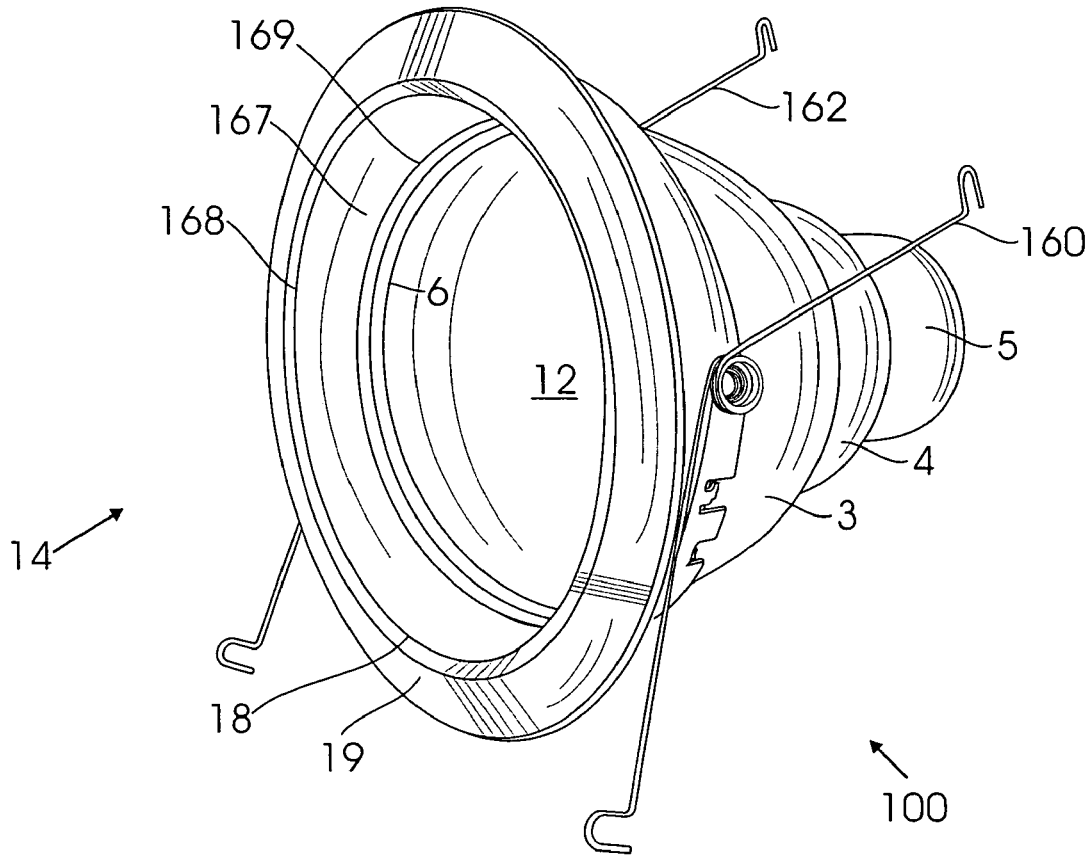
FIG. 2 is a perspective view of one embodiment the present invention improved lightbulb housing installed into a ceiling fixture to conceal a plug-on fluorescent lightbulb and provide an illumination effect similar to a reflector lightbulb.
Figure 3A:
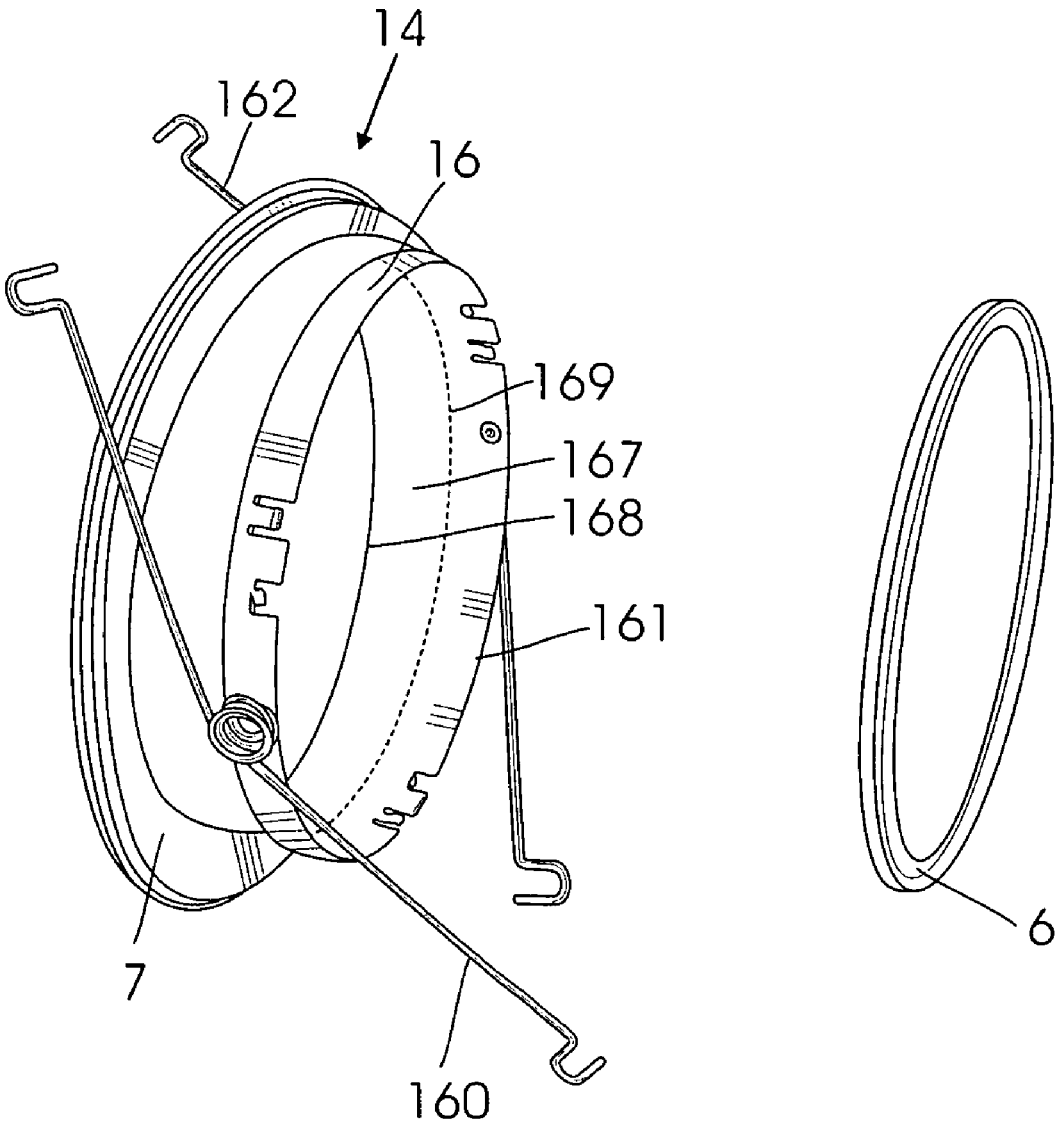
FIG. 3A is a perspective view of the top ring assembly with sealing gasket removed for the embodiment of the present invention illustrated in FIG. 3.

Referring to FIG. 2, there is illustrated a perspective view of the present invention improved lightbulb housing 100 and referring to FIG. 3 there is illustrated an exploded view of the present invention improved lightbulb housing 100. FIG. 3A is an exploded view of the ring cover portion of the improved lightbulb housing 100.

Figure 4:
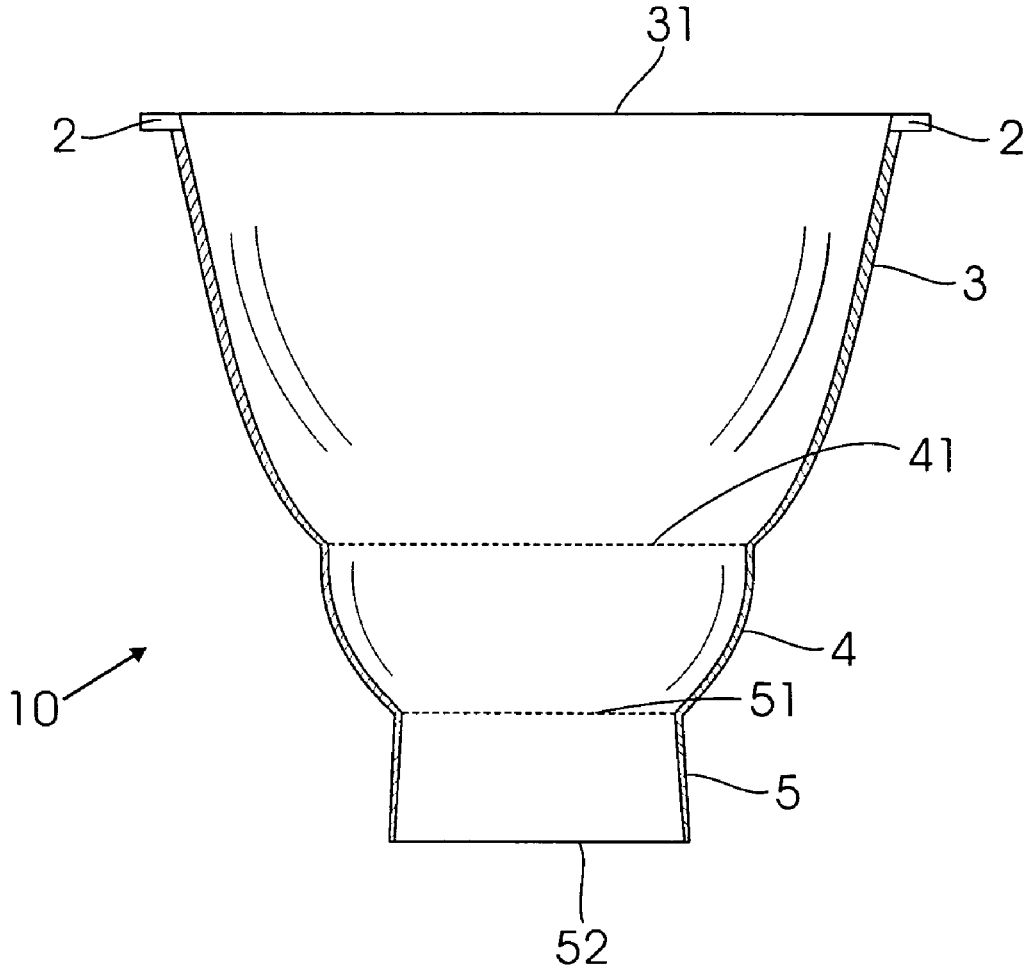
FIG. 4 is a cross-sectional side elevational view of the reflector used with the present invention.

Referring to FIGS. 2, 3, and 3A, the primary components of a preferred embodiment of the present invention improved lightbulb housing 100 are a reflector 10, a frosted and translucent lens 12, a rubber ring or gasket 6 and a top ring cover 14. Referring to FIG. 2 and the cross-sectional view of FIG. 4, the reflector 10 is a single structure having an outer wall which by way of example can be comprised of three sections, a bottom baffle 5, a middle baffle 4, and an upper baffle 3. The bottom baffle 3 is hollow and generally cylindrical with a bottom end 52 and a top end 51. The middle baffle 4 is rounded or cup shaped with a bottom end 42 which adjoins the top end 51 of bottom baffle 5. The middle baffle 4 has a top end 41. The upper baffle 3 is also rounded or cup shaped having a bottom end 52 which adjoins the middle baffle 4 at its top end 41. The upper baffle 3 also has a top end 31 which extends into an upper transverse circumferential wall 2. The three baffles are aligned so that their respective center-lines are aligned and are symmetrical about the center-line the reflector 10. Referring to Figure, the bottom baffle 5 has at least one transverse 54 through which electrical wires are fed. It will be appreciated that it is within the spirit and scope of the present invention to have at least one hole for a wire to pass through.

Referring to FIGS. 2, 3 and 3A, there is illustrated hollow top ring cover 14 which comprises an outer wall such as cylindrical wall 16 having a top circumference 168 which extends into an upper circumferential ring 18 which in turn extends into an upper transverse outer ring 19. It will be appreciated that it also within the spirit and scope of the present for the top circumference 168 of the hollow cylindrical wall 16 to extend directly into the upper transverse outer ring 19. A sealing ring 7 is positioned around the hollow cylindrical wall 16 at a location immediately beneath the upper transverse outer ring 19. The sealing ring 7 can be a loose fit or can be affixed to the bottom of the upper transverse outer ring 19 by means such as adhesives.

The top ring cover 14 is attached to the interior of cylinder 91 of the housing fixture (See FIG. 6) by connecting means which way of example can be a pair of snapper assemblies 150 and 152. Each snapper assembly is respectively affixed at oppositely disposed locations on the hollow cylindrical wall 16 by attachment means such as rivets 151 and 153. Each snapper assembly 150 and 152 is respectively comprised of a pair of snapper connectors 160 and 162. Referring to FIGS. 3 and 3A, the bottom 161 of the cylindrical wall 16 has three sets of hooks 163*a*, 163*b*, 163*c*, 163*d*, 163*e* and 163*f*. The first set comprised of hooks 163*a* and 163*b* are adjacent one another. The second set comprised of hooks 163*c* and 163*d* are adjacent one another. The third set comprised of hooks 163*e* and 163*f* are adjacent one another. The sets of hooks are spaced approximately one-hundred and twenty (120) degrees apart. As best illustrated in FIG. 3, the hooks 163*a*, 163*b*, 163*c*, 163*d*, 163*e* and 163*f* are used to lock the top ring cover 14 to the reflector 10. It will be appreciated that it is also within the spirit and scope of the present invention to have at least one hook member at spaced apart locations rather than pairs of hook members and the present invention will work with at least one hook member but preferably there should be least two oppositely disposed hook members to retain the ring assembly 14 onto the reflector 10.

As illustrated in FIG. 3A, the interior of the hollow cylindrical wall 16 has an interior transverse circumferential shelf 169 positioned at a location between the bottom 161 and transverse outer ring 19. A rubber sealing gasket 6 is positioned to rest immediately below the interior transverse circumferential shelf 169. The rubber gasket 6 can be press fit against the interior transverse circumferential shelf 169 or alternatively can be affixed thereto by means such as adhesive means.

A frosted and translucent lens 12 is positioned so that it rests on upper transverse circumferential wall 2 of reflector 10 and between the rubber sealing gasket 6 or against the interior transverse circumferential shelf 169 if there is no rubber sealing gasket and is held in place when the hooks 163*a*, 163*b*, 163*c*, 163*d*, 163*e* and 163*f* are snapped onto the top 31 of upper baffle 3 of the reflector 10. In this orientation, the frosted and translucent lens 12 conceals the rivets 151 and 153 or other attaching means by which the snapper assemblies 150 and 152 are affixed to the cylindrical wall 16 of the top ring cover 14. The completed present invention housing 100 is shown in the perspective view of FIG. 2.

The interior surface 167 of the cylindrical wall 16 of the top ring cover 14 can have different wall designs between the top 168 of the interior surface 167 and the interior transverse circumferential shelf 169. In one variation illustrated in FIG. 2, the interior wall 167 is smooth. In another variation illustrated in FIG. 3, the interior wall 167 is baffled having baffles or grooves 32. In each case, the smooth interior wall 167 or the grooves 32 of the baffle are visible since they are above the location of the frosted and translucent lens 12. Therefore, when incorporating a smooth interior surface 167, the top ring cover 14 serves as a full light reflector whereas when used with the baffles 32, the light reflection is reduced.

It will be appreciated that the present invention can operate wherein the reflector 10 comprises the bottom hollow cylindrical baffle 5 connected at least one of the upper baffles. Furthermore, the present invention still can operate if the reflector 10 is a circular hollow elongated structure having the rim 2 at a front end of the structure containing a bottom end, as long as a lightbulb can be inserted into the hollow structure.

Figure 5:
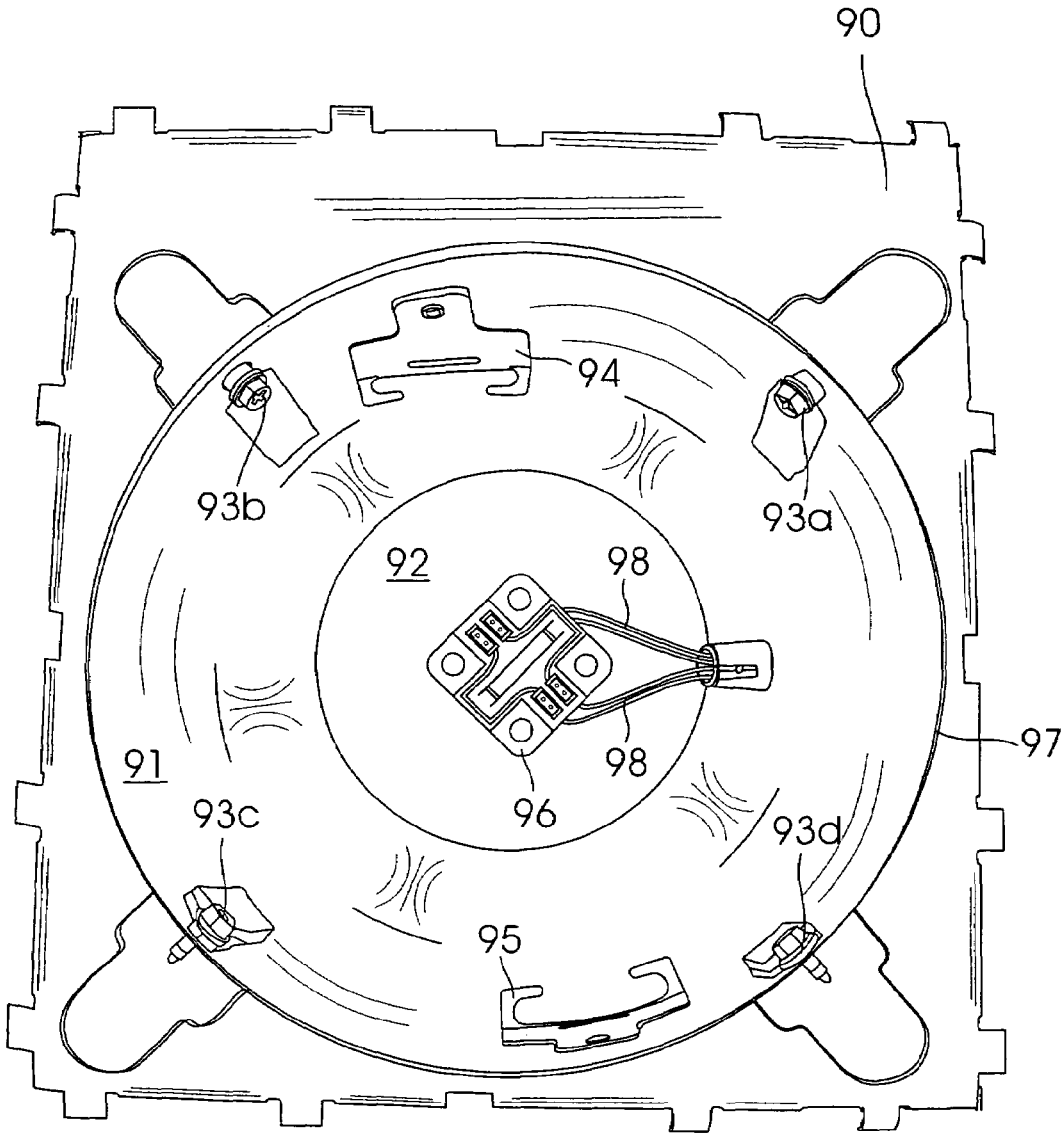
FIG. 5 is a top plan view looking into the reflector illustrating the socket to receive the plug-in fluorescent lightbulb.
Figure 6:
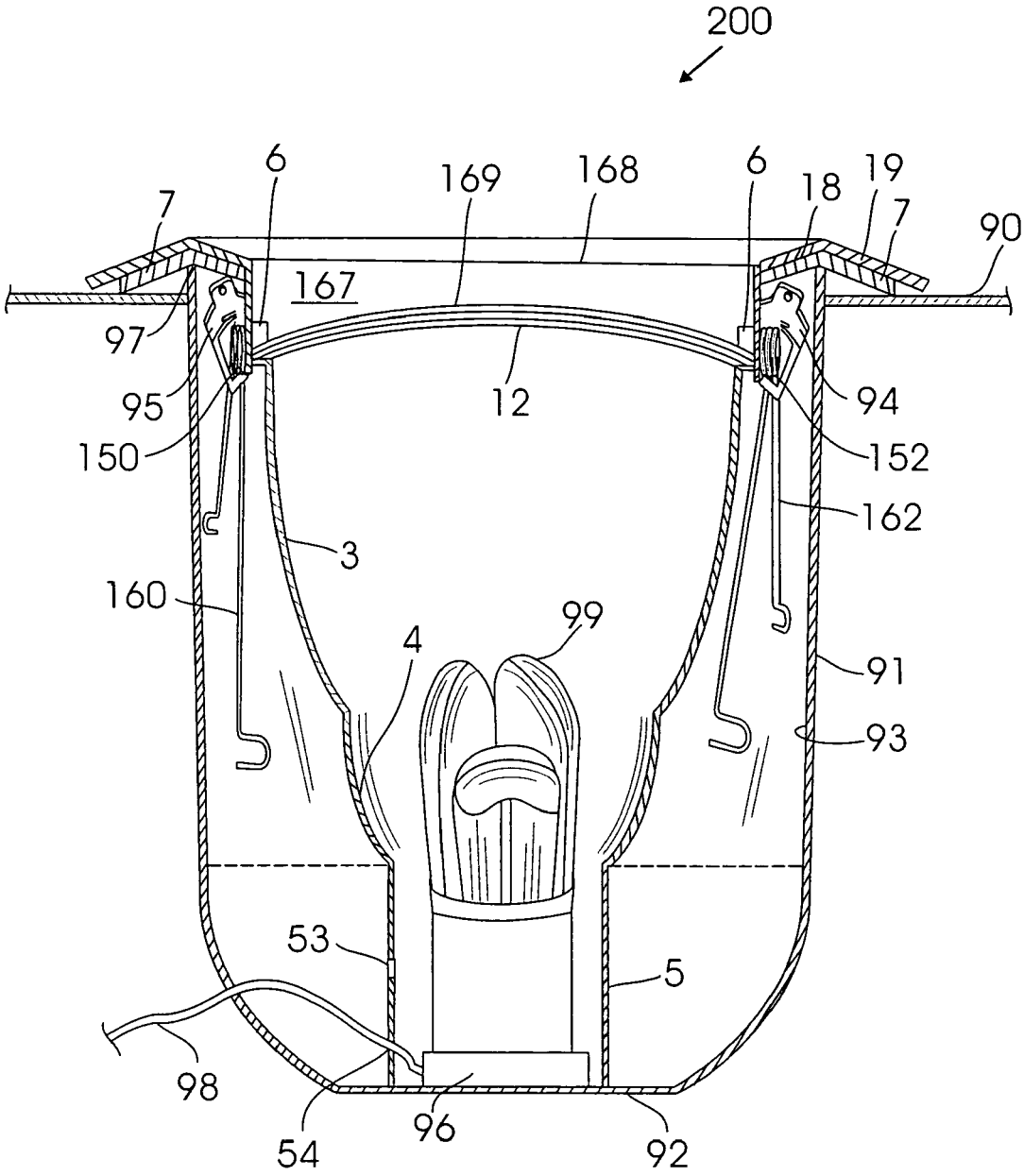
FIG. 6 is a cross-section view of a ceiling fixture with a plug-in fluorescent lightbulb shielded by the present invention translucent and frosted lens to provide a visual illumination effect of a reflector lightbulb.

Referring to a top plan view of FIG. 6, there is illustrated the canister 91 transversely affixed into the ceiling plate 90, wherein the canister 91 is used for installation of the lightbulb housing 100. As illustrated in FIG. 6, the canister 91 is transversely affixed into the ceiling plate 90, wherein the cylindrical canister 91 at its top circumference 97 is inserted into a central hole of the ceiling plate 90, and affixed to the plate through four screws 93*a*, 93*b*, 93*c*, and 93*d* (See FIG. 5). The cylindrical canister 91 further comprises a flatted bottom 92, wherein an electric socket 96 is installed at a center location of the bottom 92 for connecting a lightbulb 99 (See FIG. 5). The interior wall 93 of canister 91 further comprises a pair of oppositely disposed snapper retaining members 94 and 95 which are affixed to the interior wall 93 at a location below the top 97 of canister 91.

Figure 1:
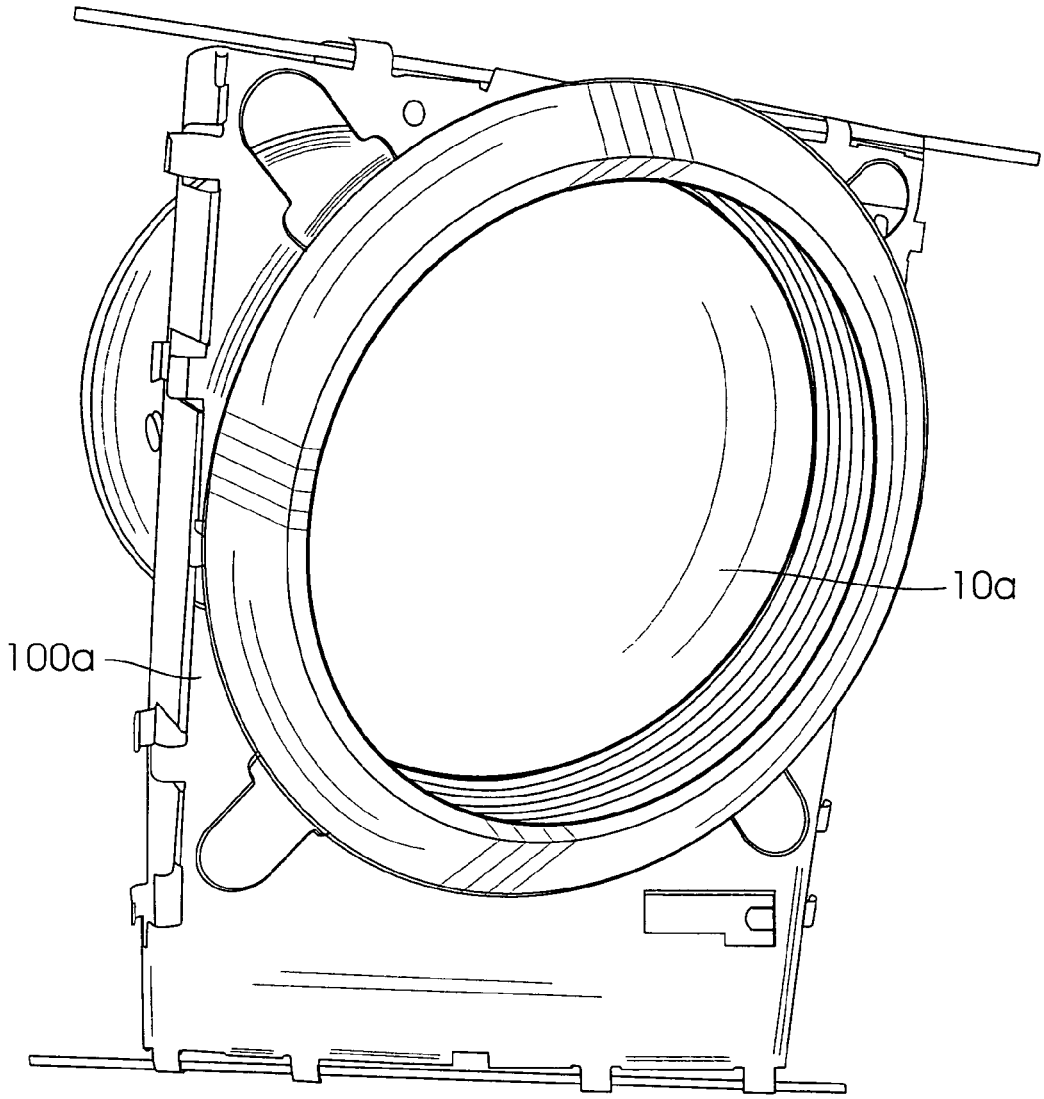
Fig. 1 PRIOR ART
FIG. 1 is a perspective view of a prior art ceiling fixture with a reflector lightbulb therein, illustrating the visual effect achieved from the reflector lightbulb which is visible from the housing.
Figure 7:
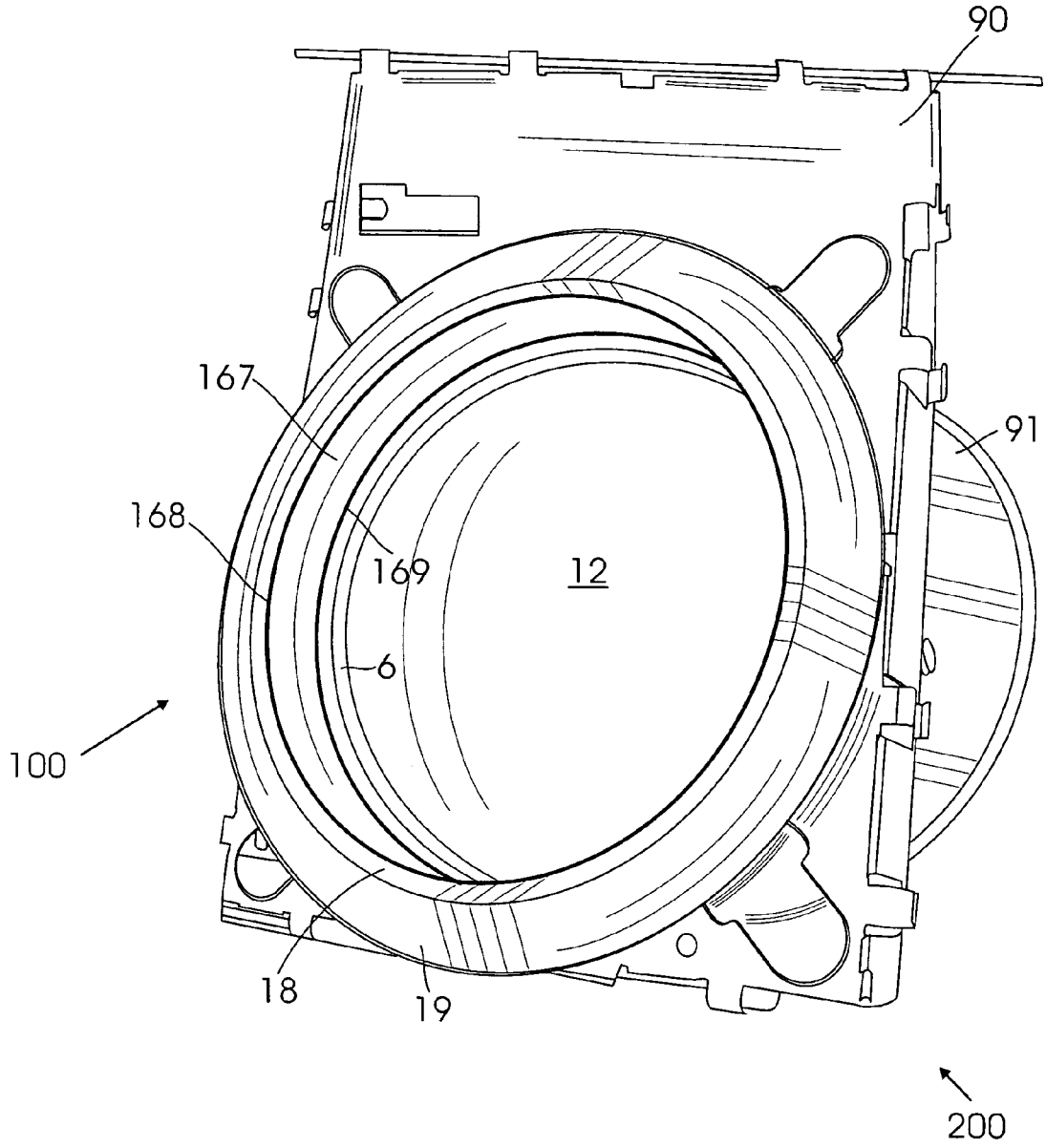
FIG. 7 is a perspective view of a ceiling fixture with a plug-in fluorescent lightbulb shielded by the present invention translucent and frosted lens to provide a visual illumination effect of a reflector lightbulb.

Referring to FIGS. 6 and 7, the assembly of the present invention improved lightbulb housing assembly 100 is illustrated, wherein the lightbulb housing 100 is affixed into the canister 91 through connections of the right side snapper connector 160 to the respective snapper retainer 94, and the left side snapper connector 162 to the respective snapper retainer 95 of the canister 91. The plug-in fluorescent lightbulb 99 is plugged into the electric plug before the lightbulb assembly 100 is affixed. Therefore, when affixed, the plug-in fluorescent lightbulb 99 extends into the reflector 10 and extends through the bottom hollow baffle 5, the middle hollow baffle 4 and into the top hollow baffle 3 as illustrated in FIG. 6. The wires 98 of the electric plug 96 extend through the at least one of the opening 54 in bottom hollow baffle 5. Through the attachment of the snapper members 160 and 162 into the respective snapper retainers 94 and 95, the lightbulb housing 100 is press fitted into the canister 91, wherein the bottom circumference 52 of the reflector 10 contacts the inner surface on the bottom 92 of the canister 91, and the rear side of the cushion ring 7 touches the top circumference 97 of the canister 91 to thereby seal the canister 91. As a result, when the assembly 200 is illuminated, the plug-in fluorescent bulb 99 is concealed by the frosted and translucent lens 12 so that the illumination comes through the frosted and translucent lens and the viewer is unable to actually see the source of illumination such as the plug-in fluorescent lightbulb 99. As illustrated in FIG. 7, the visual effect is similar to the visual effect achieved from a reflector lightbulb as illustrated in FIG. 1 and in particular, similar to an incandescent BR30/BR40 reflector lightbulb. In addition, the transverse exterior ring 16 can be made of decorative material to further enhance the beauty of the fixture since the decorative exterior ring 16 is visible against the ceiling fixture.

Defined in detail, the present invention is an improved lightbulb housing for use with a ceiling fixture having a canister containing a socket assembly for a plug-in fluorescent lightbulb which is retained therein and at least one electrical wire extending from the socket assembly, the canister also having a pair of oppositely disposed snapper retainers and also having a top wall, the improved lightbulb housing comprising: (a) a reflector having a bottom generally cylindrical hollow baffle extending into a middle hollow baffle which extends into an upper hollow baffle terminating in an upper transverse circumferential wall, the baffles aligned so that their respective center-lines are aligned and are symmetrical about the center-line; (b) a hollow top ring cover having a cylindrical wall with a top end and a bottom end, the top end extending into an upper transverse outer ring, a sealing ring positioned around the cylindrical wall at a location immediately beneath the upper transverse outer ring, an interior transverse circumferential shelf located between the top end and the bottom end, a pair of oppositely disposed snapper assembles affixed by attaching means to the cylindrical wall at a location adjacent the bottom, each snapper assembly, having a pair of snapper connectors, and a multiplicity of spaced apart attaching hook members located on the bottom of the cylindrical wall; (c) a sealing gasket positioned against the underside of the interior transverse circumferential shelf and a frosted and translucent lens positioned against the sealing gasket, the hook members of the hollow ring cover attached to the upper baffle of the reflector so that the frosted and translucent lens is retained between the upper transverse circumferential wall of the reflector and the gasket; and (d) the reflector placed into the canister of the ceiling fixture so that the lightbulb extends into the reflector and the hollow top ring cover is retained into the canister by a respective snapper connector received within a respective snapper retainer, the wire from the electric socket extending through the at least one opening in the bottom baffle so that as illumination occurs from the plug-in fluorescent lightbulb, the frosted and translucent lens conceals the lightbulb from view while permitting illumination to shine through and also conceals the means by which the snapper assemblies are attached to the cylindrical wall, the sealing ring pressed against the top wall of the canister, the frosted and translucent lens creating a visual effect similar to the visual effect achieved by a reflector lightbulb.

Defined more broadly, the present invention is an improved lightbulb housing for use with a ceiling fixture having a canister containing a socket assembly for a plug-in lightbulb which is retained therein and at least one electrical wire extending from the socket assembly, the canister also having a pair of oppositely disposed snapper retainers, the improved lightbulb housing comprising: (a) reflector having an outer wall which surrounds an interior chamber, the outer wall having a top end with an upper transverse circumferential wall, and a bottom end, the outer wall having at least one opening adjacent the bottom end; (b) a hollow top cover having an outer wall with a top end and a bottom end, the top end extending into an upper transverse outer ring, an interior transverse circumferential shelf located between the top end and the bottom end, a pair of oppositely disposed snapper assembles affixed by attaching means to the cylindrical wall at a location adjacent the bottom, each snapper assembly having a pair of snapper connectors, and at least two spaced apart attaching hook members located on the bottom of the cylindrical wall; (c) a frosted and translucent lens positioned against the underside of the interior transverse circumferential shelf, the hook members of the hollow top cover attached to the reflector so that the frosted and translucent lens is retained between the upper transverse circumferential wall of the reflector and the interior transverse circumferential shelf; and (d) the reflector placed into the canister of the ceiling fixture so that the plug-in fluorescent lightbulb extends into the reflector and the hollow top cover is retained into the canister by a respective snapper connector received within a respective snapper retainer, the wire from the electric socket extending through the at least one opening in the reflector so that as illumination occurs from the plug-in fluorescent lightbulb, the frosted and translucent lens conceals the plug-in fluorescent lightbulb from view while permitting illumination to shine through and also conceals the means by which the snapper assemblies are attached to the cylindrical wall, the frosted and translucent lens creating a visual effect similar to the visual effect achieved by a reflector lightbulb.

Defined even more broadly, the present invention is an improved lightbulb housing for use with a ceiling fixture having a lightbulb retaining means containing a socket assembly for a plug-in fluorescent lightbulb which is retained therein and at least one retaining member, the improved lightbulb housing comprising: (a) reflector having an outer wall which surrounds an interior chamber, the outer wall having a top end with an upper transverse circumferential wall, and a bottom end; (b) a hollow top cover having an outer wall with a top end and a bottom end, the top end extending into an upper transverse outer ring, an interior transverse circumferential shelf located between the top end and the bottom end, at least one connector means attached to the outer wall at a location adjacent the bottom, and at least one attaching member located on the outer wall; (c) a frosted and translucent lens positioned against the underside of the interior transverse circumferential shelf, the at least one attaching member of the hollow top cover attached to the reflector so that the frosted and translucent lens is retained between the upper transverse circumferential wall of the reflector and the interior transverse circumferential shelf; and (d) the reflector placed into the lightbulb retaining means of the ceiling fixture so that the plug-in fluorescent lightbulb extends into the reflector and the hollow top cover is retained therein by the at least one connector member being attached to the at least one retaining member so that as illumination occurs from the plug-in fluorescent lightbulb, the frosted and translucent lens conceals the plug-in fluorescent lightbulb from view while permitting illumination to shine through, the frosted and translucent lens creating a visual effect similar to the visual effect achieved by a reflector lightbulb.

Defined most broadly, the present invention is an improved lightbulb housing for use with a ceiling fixture having a lightbulb retaining means containing a socket assembly for a plug-in fluorescent lightbulb which is retained therein, the improved lightbulb housing comprising: (a) a reflector having an outer wall which surrounds an interior chamber, the outer wall having a top end with an upper transverse circumferential wall, and a bottom end; (b) an apparatus for retaining a frosted and translucent lens which is retained on the reflector so as to shield the interior of the reflector; and (c) the reflector placed into a lightbulb retaining means of a ceiling fixture so that the plug-in fluorescent lightbulb extends into the reflector so that as illumination occurs from the plug-in fluorescent lightbulb, the frosted and translucent lens conceals the plug-in fluorescent lightbulb from view while permitting illumination to shine through, the frosted and translucent lens creating a visual effect similar to the visual effect achieved by a reflector lightbulb.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An improved lightbulb housing for use with a ceiling fixture having a canister containing a socket assembly for a plug-in fluorescent lightbulb which is retained therein and at least one electrical wire extending from the socket assembly, the canister also having a pair of oppositely disposed snapper retainers and also having a top wall, the improved lightbulb housing comprising:

a. a reflector having a bottom generally cylindrical hollow baffle extending into a middle hollow baffle which extends into an upper hollow baffle terminating in an upper transverse circumferential wall, the baffles aligned so that their respective center-lines are aligned and are symmetrical about the center-line, the bottom baffle having a wall having at least one hole;

b. a hollow top ring cover having a cylindrical wall with a top end and a bottom end, the top end extending into an upper transverse outer ring, a sealing ring positioned around the cylindrical wall at a location immediately beneath the upper transverse outer ring, an interior transverse circumferential shelf located between the top end and the bottom end, a pair of oppositely disposed snapper assembles affixed by attaching means to the cylindrical wall at a location adjacent the bottom, each snapper assembly having a pair of snapper connectors, and a multiplicity of spaced apart attaching hook members located on the bottom of the cylindrical wall, the snapper connectors having a clamp shape;

c. a sealing gasket positioned against the underside of the interior transverse circumferential shelf and a frosted and translucent lens positioned against the sealing gasket, the hook members of the hollow ring cover attached to the upper baffle of the reflector so that the frosted and translucent lens is retained between the upper transverse circumferential wall of the reflector and the gasket; and d. the reflector placed into the canister of the ceiling fixture so that the lightbulb socket is positioned within the bottom baffle, and the middle baffle ending and the bottom baffle beginning at a point approximately near the upper end of the lightbulb socket, the bottom baffle extending backwardly away from the trim, the bottom baffle having a hole through which connecting electrical wires may reach and interconnect with the lightbulb socket residing therein, the wire from the electric socket extending through the at least one opening in the bottom baffle so that as illumination occurs from the plug-in fluorescent lightbulb, the frosted and translucent lens conceals the lightbulb from view while permitting illumination to shine through and also conceals the means by which the snapper assemblies are attached to the cylindrical wall, the sealing ring pressed against the top wall of the canister, the frosted and translucent lens creating a visual effect similar to the visual effect achieved by a reflector lightbulb.

2. The lightbulb housing in accordance with claim 1 wherein said cylindrical wall has an interior surface at a location between the top and the frosted and translucent lens which is smooth.

3. The lightbulb housing in accordance with claim 1 wherein said cylindrical wall has an interior surface at a location between the top and the frosted and translucent lens which has grooves.

4. The lightbulb housing in accordance with claim 1 wherein said gasket is affixed to the underside of the interior transverse circumferential shelf.

5. The lightbulb housing in accordance with claim 1 wherein said sealing ring is affixed to the underside of the upper transverse circumferential wall of the top ring cover.

6. An improved lightbulb housing for use with a ceiling fixture having a canister containing a socket assembly for a plug-in lightbulb which is retained therein and at least one electrical wire extending from the socket assembly, the canister also having a pair of oppositely disposed snapper retainers, the improved lightbulb housing comprising:

a. reflector having an outer wall which surrounds an interior chamber, the outer wall having a top end with an upper transverse circumferential wall, and a bottom end, the outer wall having at least one opening adjacent the bottom end, and a bottom baffle having a wall having at least one hole;

b. a hollow top cover having an outer wall with a top end and a bottom end, the top end extending into an upper transverse outer ring, an interior transverse circumferential shelf located between the top end and the bottom end, a pair of oppositely disposed snapper assemblies affixed by attaching means to the cylindrical wall at a location adjacent the bottom, each snapper assembly having a pair of snapper connectors, and at least two spaced apart attaching hook members located on the bottom of the cylindrical wall, the snapper connectors having a clamp shape;

c. a frosted and translucent lens positioned against the underside of the interior transverse circumferential shelf, the hook members of the hollow top cover attached to the reflector so that the frosted and translucent lens is retained between the upper transverse circumferential wall of the reflector and the interior transverse circumferential shelf; and d. the reflector placed into the canister of the ceiling fixture so that the plug-in fluorescent lightbulb socket is positioned within the bottom baffle, and a middle baffle ending and the bottom baffle beginning at a point approximately near the upper end of the lightbulb socket, the bottom baffle extending backwardly away from the trim, the bottom baffle having a hole through which connecting electrical wires may reach and interconnect with the lightbulb socket residing therein, the wire from the electric socket extending through the at least one opening in the reflector so that as illumination occurs from the plug-in fluorescent lightbulb, the frosted and translucent lens conceals the plug-in fluorescent lightbulb from view while permitting illumination to shine through and also conceals the means by which the snapper assemblies are attached to the cylindrical wall, the frosted and translucent lens creating a visual effect similar to the visual effect achieved by a reflector lightbulb.

7. The lightbulb housing in accordance with claim 6 wherein said cylindrical wall has an interior surface at a location between the top and the frosted and translucent lens which is smooth.

8. The lightbulb housing in accordance with claim 6 wherein said cylindrical wall has an interior surface at a location between the top and the frosted and translucent lens which has grooves.

9. The lightbulb housing in accordance with claim 6 further comprising a gasket affixed to the underside of the interior transverse circumferential shelf so that the frosted and translucent lens rests against the gasket.

10. The lightbulb housing in accordance with claim 6 further comprising a sealing ring positioned against the underside of the upper transverse circumferential wall of the top ring cover.

11. An improved lightbulb housing for use with a ceiling fixture having a lightbulb retaining means containing a socket assembly for a plug-in fluorescent lightbulb which is retained therein and at least one retaining member, the improved lightbulb housing comprising:

a. a reflector having an outer wall which surrounds an interior chamber, the outer wall having a top end with an upper transverse circumferential wall, a bottom end, and a bottom baffle having a wall having at least one hole;

b. a hollow top cover having an outer wall with a top end and a bottom end, the top end extending into an upper transverse outer ring, an interior transverse circumferential shelf located between the top end and the bottom end, at least one connector means attached to the outer wall at a location adjacent the bottom, and at least one attaching member located on the outer wall, the connectors having a clamp shape;

c. a frosted and translucent lens positioned against the underside of the interior transverse circumferential shelf, the at least one attaching member of the hollow top cover attached to the reflector so that the frosted and translucent lens is retained between the upper transverse circumferential wall of the reflector and the interior transverse circumferential shelf; and d. the reflector placed into the lightbulb retaining means of the ceiling fixture so that the plug-in fluorescent lightbulb socket is positioned within the bottom baffle, and a middle baffle ending and the bottom baffle beginning at a point approximately near the upper end of the lightbulb socket, the bottom baffle extending backwardly away from the trim, the bottom baffle having a hole through which connecting electrical wires may reach and interconnect with the lightbulb socket residing therein and the hollow top cover is retained therein by the at least one connector member being attached to the at least one retaining member so that as illumination occurs from the plug-in fluorescent lightbulb, the frosted and translucent lens conceals the plug-in fluorescent lightbulb from view while permitting illumination to shine through, the frosted and translucent lens creating a visual effect similar to the visual effect achieved by a reflector lightbulb.

12. The lightbulb housing in accordance with claim 11 wherein said outer wall has an interior surface at a location between the top and the frosted and translucent lens which is smooth.

13. The lightbulb housing in accordance with claim 11 wherein said outer wall has an interior surface at a location between the top and the frosted and translucent lens which has grooves.

14. The lightbulb housing in accordance with claim 11 further comprising a gasket affixed to the underside of the interior transverse circumferential shelf so that the frosted and translucent lens rests against the gasket.

15. The lightbulb housing in accordance with claim 11 further comprising a sealing ring positioned against the underside of the upper transverse circumferential wall of the top ring cover.

16. An improved lightbulb housing for use with a ceiling fixture having a lightbulb retaining means containing a socket assembly for a plug-in fluorescent lightbulb which is retained therein, the improved lightbulb housing comprising:

a. reflector having an outer wall which surrounds an interior chamber, the outer wall having a top end with an upper transverse circumferential wall, and a bottom end, and a bottom baffle having a wall having at least one hole;

b. an apparatus for retaining a frosted and translucent lens which is retained on the reflector so as to shield the interior of the reflector; and c. the reflector placed into a lightbulb retaining means of a ceiling fixture so that the plug-in fluorescent lightbulb extends into the reflector so that as illumination occurs from the plug-in fluorescent lightbulb, the frosted and translucent lens conceals the plug-in fluorescent lightbulb from view while permitting illumination to shine through, the frosted and translucent lens creating a visual effect similar to the visual effect achieved by a reflector lightbulb.

* * * * *